United States Patent [19]

Hinz et al.

[11] Patent Number: 4,825,883

[45] Date of Patent: May 2, 1989

[54] METHOD OF AND MACHINE FOR MAKING FILTER CIGARETTES FROM PAIRS OF PLAIN CIGARETTES OF DOUBLE UNIT LENGTH

[75] Inventors: Werner Hinz, Lauenburg; Erwin Oesterling, Glinde; Siegfried Schlisio, Geesthacht, all of Fed. Rep. of Germany

[73] Assignee: Körber AG, Hamburg, Fed. Rep. of Germany

[21] Appl. No.: 159,216

[22] Filed: Feb. 23, 1988

[30] Foreign Application Priority Data

Mar. 3, 1987 [DE] Fed. Rep. of Germany ..... 3706571

[51] Int. Cl.[4] ..... A24C 5/47

[52] U.S. Cl. ..... 131/94

[58] Field of Search ..... 131/94

[56] References Cited

U.S. PATENT DOCUMENTS

| | | | |
|---|---|---|---|
| Re. 25,917 | 11/1965 | Stelzer | 131/94 |
| Re. 26,900 | 5/1970 | Bohn et al. | 131/94 |
| 3,164,242 | 1/1965 | Schubert et al. | 131/94 |
| 3,176,825 | 4/1965 | Rudszinat et al. | 131/94 |
| 3,245,414 | 4/1966 | Rudszinat | 131/94 |
| 3,306,306 | 2/1967 | Rudszinat | 131/94 |
| 3,308,832 | 3/1967 | Stelzer et al. | 131/94 |
| 3,340,757 | 9/1967 | Rudszinat | 131/94 |
| 3,527,234 | 9/1970 | Hinzmann | 131/94 |
| 3,535,003 | 10/1970 | Rudszinat et al. | 131/94 |
| 3,583,546 | 6/1971 | Koop | 131/94 |

*Primary Examiner*—V. Millin

[57] ABSTRACT

A mass-producing filter tipping machine wherein two coaxial plain cigarettes of unit length are simultaneously severed to yield pairs of coaxial plain cigarettes of unit length which are moved apart to provide spaces for filter mouthpieces of double unit length. This results in the formation of two rows of groups of three coaxial rod-shaped articles each, namely, two plain cigarettes of unit length and a filter mouthpiece of double unit length between them. The filter mouthpieces are connected with the respective pairs of cigarettes of unit length by adhesive-coated uniting bands so that each filter mouthpiece and the respective pair of cigarettes of unit length jointly constitute a filter cigarettes of double unit length. Uniting bands are obtained from two discrete webs of adhesive-coated tipping paper. The leaders of the webs are attracted to the peripheral surface of a suction conveyor which cooperates with two sets of orbiting knives serving to repeatedly sever the leaders of the respective webs to form two series of discrete uniting bands. Successive uniting bands of the two series are applied to successive groups of the two rows before the uniting bands are convoluted around the respective groups.

13 Claims, 3 Drawing Sheets

METHOD OF AND MACHINE FOR MAKING FILTER CIGARETTES FROM PAIRS OF PLAIN CIGARETTES OF DOUBLE UNIT LENGTH

CROSS-REFERENCE TO RELATED CASES

The machine of the present invention is similar to those described in the commonly owned copending patent applications Ser. Nos. 159,122 and 159,206, both filed Feb. 23, 1988.

BACKGROUND OF THE INVENTION

The invention relates to improvements in methods of and in machines for making rod-shaped smokers' products, and more particularly to improvements in methods of and in machines for making filter tipped smokers' products, such as filter cigarettes, cigars or cigarillos. For the sake of simplicity, the following description will refer to filter cigarettes with the understanding, however, that the method and machine can be used with equal or similar advantage for the making of other filter tipped smokers' products.

It is known to make filter cigarettes in a so-called filter tipping machine (typical examples of such machines are those known as MAX and MAX S which are distributed by the assignee of the present application) wherein plain cigarettes of double unit length are subdivided into pairs of coaxial plain cigarettes of unit length, a filter mouthpiece of double unit length is placed between each pair of plain cigarettes of unit length to form therewith a group of three coaxial rod-shaped articles, and the articles of each group are thereupon connected to each other by adhesive-coated uniting bands each of which is convoluted around the respective filter mouthpiece of double unit length and around the adjacent inner end portions of the corresponding plain cigarettes of unit length. The resulting filter cigarettes of double unit length are severed midway between their ends so that each such cigarette yields a pair of coaxial filter cigarettes of unit length. One filter cigarette of each pair is turned end-for-end to ensure that the filter mouthpieces of all filter cigarettes of unit length will face in the same direction before the thus obtained single row of filter cigarettes of unit length is admitted into storage or into a packing machine. It is further customary to inspect the filter cigarettes of unit length in order to ascertain the condition of their wrappers and/or to ascertain the density of unattached ends of the respective plain cigarettes. It is also known to provide filter cigarettes with perforations in order to enable atmospheric air to penetrate into the column of tobacco smoke when the filter cigarette is lighted and the smoker draws tobacco smoke into her or his mouth.

Filter tipping machines normally receive plain cigarettes directly from a cigarette rod making machine, e.g., from a machine known as PROTOS which is distributed by the assignee of the present application. As a rule, a cigarette rod making machine (also called maker) turns out a single continuous cigarette rod which is subdivided into plain cigarettes of unit length or multiple unit length, and the thus obtained cigarettes are then transported to storage or to the filter tipping machine. Certain recent types of cigarette rod making machines are designed to simultaneously produce two parallel cigarette rods which are subdivided by so-called cutoffs so as to yield files of plain cigarettes of unit length or multiple unit length. The plain cigarettes are delivered to filter tipping machines, to storage or directly to packing machines for plain cigarettes.

Commonly owned copending patent application Ser. No. 127,243 filed Dec. 1, 1987 by Peter Schumacher for "Apparatus for changing the direction of transport of rod-shaped articles of the tobacco processing industry" discloses an apparatus which can accept plain cigarettes coming from a maker that turns out two cigarette rods. The apparatus employs orbiting arms which have pairs of flutes for discrete plain cigarettes and deliver plain cigarettes to the peripheral flutes of two discrete drum-shaped conveyors. The cigarettes in the flutes of one of these discrete conveyors are staggered relative to the cigarettes in the flutes of the other conveyor, and the apparatus of Schumacher further comprises an additional conveyor having peripheral flutes which receive cigarettes from both discrete conveyors so that each flute of the additional conveyor contains two coaxial cigarettes. Rotary conveyors of the type disclosed by Schumacher to transport cigarettes in staggered relation to each other are described in commonly owned U.S. Pat. No. 4,051,947 to Schumacher et al.

OBJECTS AND SUMMARY OF THE INVENTION

An object of the invention is to provide a novel and improved method of making filter cigarettes at a rate greatly exceeding the rate of filter cigarette making in accordance with heretofore known methods.

Another object of the invention is to provide a novel and improved method of processing the output of cigarette makers which turn out several continuous cigarette rods.

A further object of the invention is to provide a method which can be practiced to turn out large numbers of filter cigarettes per unit of time without sacrificing the quality of such products.

An additional object of the invention is to provide a novel method of making plural series of adhesive-coated uniting bands of tipping paper.

An additional object of the invention is to provide a novel and improved filter tipping machine which can be utilized for the practice of the above outlined method and can accept and process the entire output of a maker which turns out several continuous cigarette rods.

Still another object of the invention is to provide a filter tipping machine which produces filter cigarettes at a rate greatly exceeding the output of heretofore known filter tipping machines but whose space requirements do not appreciably exceed those of conventional machines.

An additional object of the invention is to provide a machine which can accept rod-shaped articles from apparatus of the type disclosed in the aforediscussed copending patent application Ser. No. 127,243 of Schumacher.

A further object of the invention is to provide novel and improved means for transporting rod-shaped articles and uniting bands in the above outlined filter tipping machine.

Another object of the invention is to provide a production line which embodies the above outlined filter tipping machine.

Another object of the invention is to provide a filter tipping machine wherein the filter mouthpieces and the cigarettes are treated gently even though they are processed at a rate which is a multiple of the output of heretofore known cigarette makers.

A further object of the invention is to provide the filter tipping machine with novel and improved means for staggering, aligning, shuffling, shifting and otherwise manipulating rod-shaped articles which are to be assembled into filter cigarettes.

An additional object of the invention is to provide the machine with novel and improved means for making several series of adhesive-coated uniting bands.

Another object of the invention is to provide the machine with novel and improved means for transporting and otherwise manipulating plural strips or webs of tipping paper.

A further object of the invention is to provide the machine with novel and improved means for subdividing running webs of tipping paper.

Another object of the invention is to provide a novel and improved mechanism for deflecting or diverting webs of tipping paper on their way to the subdividing means.

An additional object of the invention is to provide a filter tipping machine which turns out filter cigarettes, cigars or cigarillos and embodies the above outlined uniting band making and web guiding, deflecting and severing means.

One feature of the present invention resides in the provision of a method of making filter cigarettes from plain cigarettes of double unit length, filter mouthpieces of double unit length and adhesive-coated uniting bands. The method comprises the steps of advancing two rows of parallel cigarettes of double unit length along two discrete paths in a predetermined direction, subdividing the cigarettes in each of the rows into pairs of cigarettes of unit length, introducing a filter mouthpiece of double unit length between each pair of cigarettes of unit length to thus form first and second rows of groups each containing two cigarettes of unit length and a filter mouthpiece of double unit length between them, establishing a source of supply of tipping paper, applying a coat of adhesive to one side of tipping paper, drawing tipping paper from the source, subdividing the withdrawn tipping paper into first and second series of discrete uniting bands, convoluting successive uniting bands of the first and second series of uniting bands around successive groups of the first and second rows of groups, respectively, to thus convert the groups into filter cigarettes of double unit length wherein the uniting bands connect the respective pairs of cigarettes of unit length with the filter mouthpieces of double unit length between them, and preferably the additional step of subdividing each filter cigarette of double unit length into a pair of filter cigarettes of unit length.

The source of supply can contain discrete first and second webs of tipping paper, and the drawing step then preferably comprises conveying the first and second webs along discrete first and second routes or paths. The adhesive applying step of such method preferably includes coating the discrete webs, and the step of subdividing tipping paper includes repeatedly severing the leaders of the webs at the ends of their respective routes. The distance which is covered by one of the webs from the source to the end of the respective route can exceed the distance which is covered by the other web from the source to the end of the respective route.

The method can further comprise the step of moving at least one of the webs away from the other web in a preselected portion of the respective route so that the mutual spacing of the webs at the ends of their routes is greater than the mutual spacing of the webs in the source. The moving step can include imparting to the at least one web a movement along a substantially Z-shaped portion of the respective route.

Another feature of the invention resides in the provision of a machine for making filter cigarettes from cigarettes of double unit length, filter mouthpieces of double unit length and adhesive-coated uniting bands. The machine comprises means for advancing two rows of cigarettes of double unit length along two discrete paths in a predetermined direction, means for subdividing the cigarettes in each of the rows into pairs of cigarettes of unit length, means for introducing a filter mouthpiece of double unit length between each pair of cigarettes of unit length to thus form first and second rows of groups each of which contains two cigarettes of unit length and a coaxial filter mouthpiece of double unit length between them, a source of supply of tipping paper, means for drawing tipping paper from the source, means for applying adhesive to one side of tipping paper, a device for subdividing tipping paper into first and second series of discrete adhesive-coated uniting bands, and means for convoluting successive uniting bands of the first and second series around successive groups of the first and second rows of groups to thus convert the groups into filter cigarettes of double unit length wherein the uniting bands connect the respective pairs of cigarettes of unit length with the filter mouthpieces of double unit length between them. The machine can further comprise means for subdividing each filter cigarette of double unit length into a pair of filter cigarettes of unit length, and means for assembling all filter cigarettes of unit length into a single row wherein the filter mouthpieces (of unit length) of all filter cigarettes face in the same direction so that the filter cigarettes of the single row are ready for packing.

The source can contain supplies of discrete first and second webs of tipping paper, and the drawing means then preferably comprises means for conveying the first and second webs along separate first and second routes or paths, at least in the region of the subdividing device. The conveying means can comprise means for deflecting or diverting at least one of the webs away from the other web intermediate the source and the subdividing device. The deflecting means can comprise rollers or wheels defining for the at least one web a substantially Z-shaped portion of the respective route wherein the at least one web first moves forwardly in a first direction, thereupon with a component of movement at right angles to the first direction, and then again in or close to the first direction.

The routes preferably include mutually inclined end portions which are adjacent the subdividing device. The latter can comprise a rotary suction conveyor having a perforated or foraminous peripheral surface which attracts the leaders of the webs, and first and second orbiting knives which are respectively arranged to sever the leaders of the first and second webs on the suction conveyor. The first and second knives are preferably staggered relative to each other in the circumferential direction of the suction conveyor, especially if the end portions of the first and second routes are inclined relative to each other. The inclination of the end portions of the first routes relative to each other (and hence with reference to the peripheral surface of the suction conveyor) is preferably such that the leaders of both webs overlie and are attracted to the peripheral surface of the suction conveyor along substantially identical angles intermediate the end portions of the respective routes and the respective knives.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
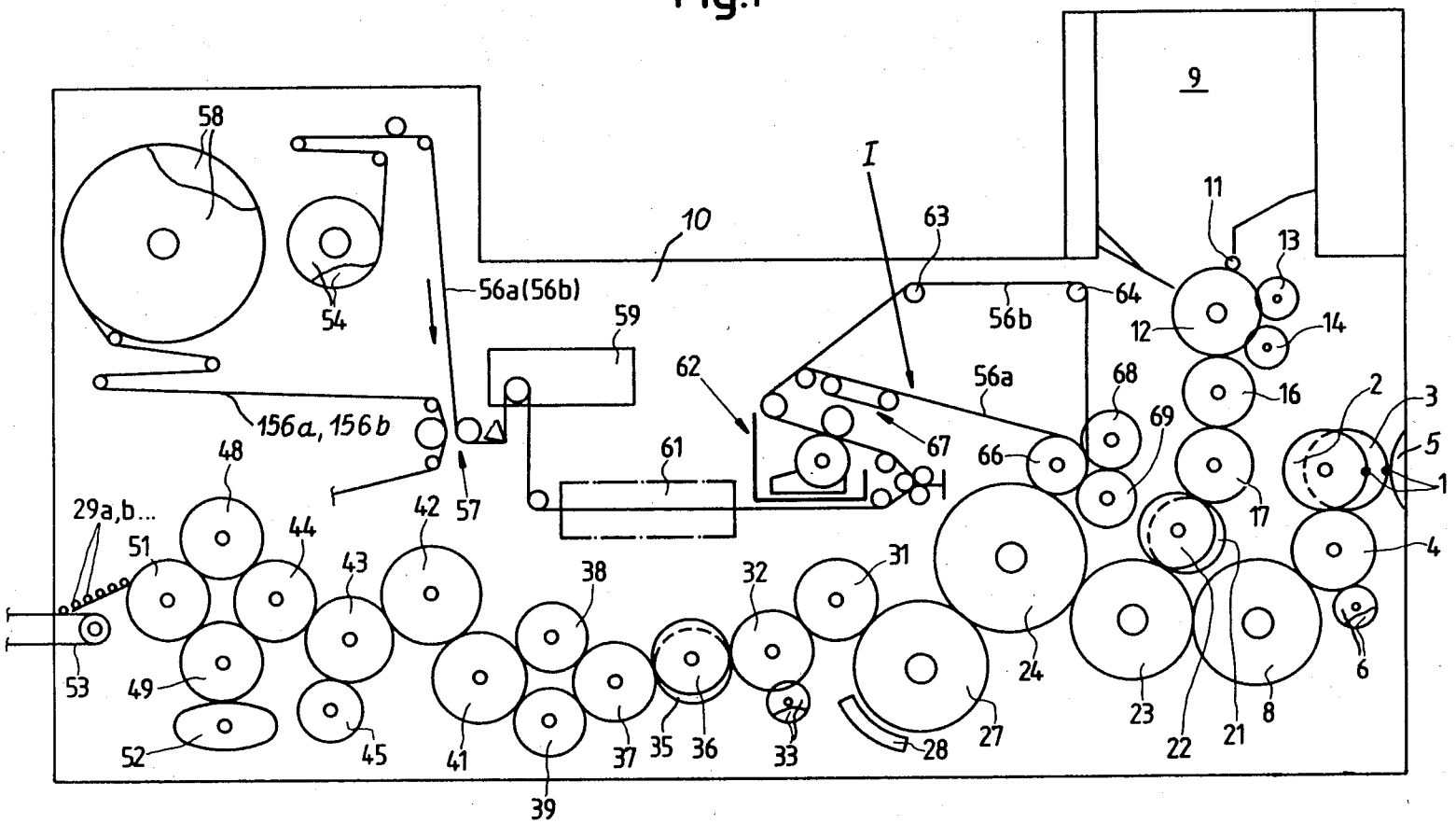
FIG. 1 is a schematic front elevational view of a filter tipping machine which embodies the invention.
Figure 2:
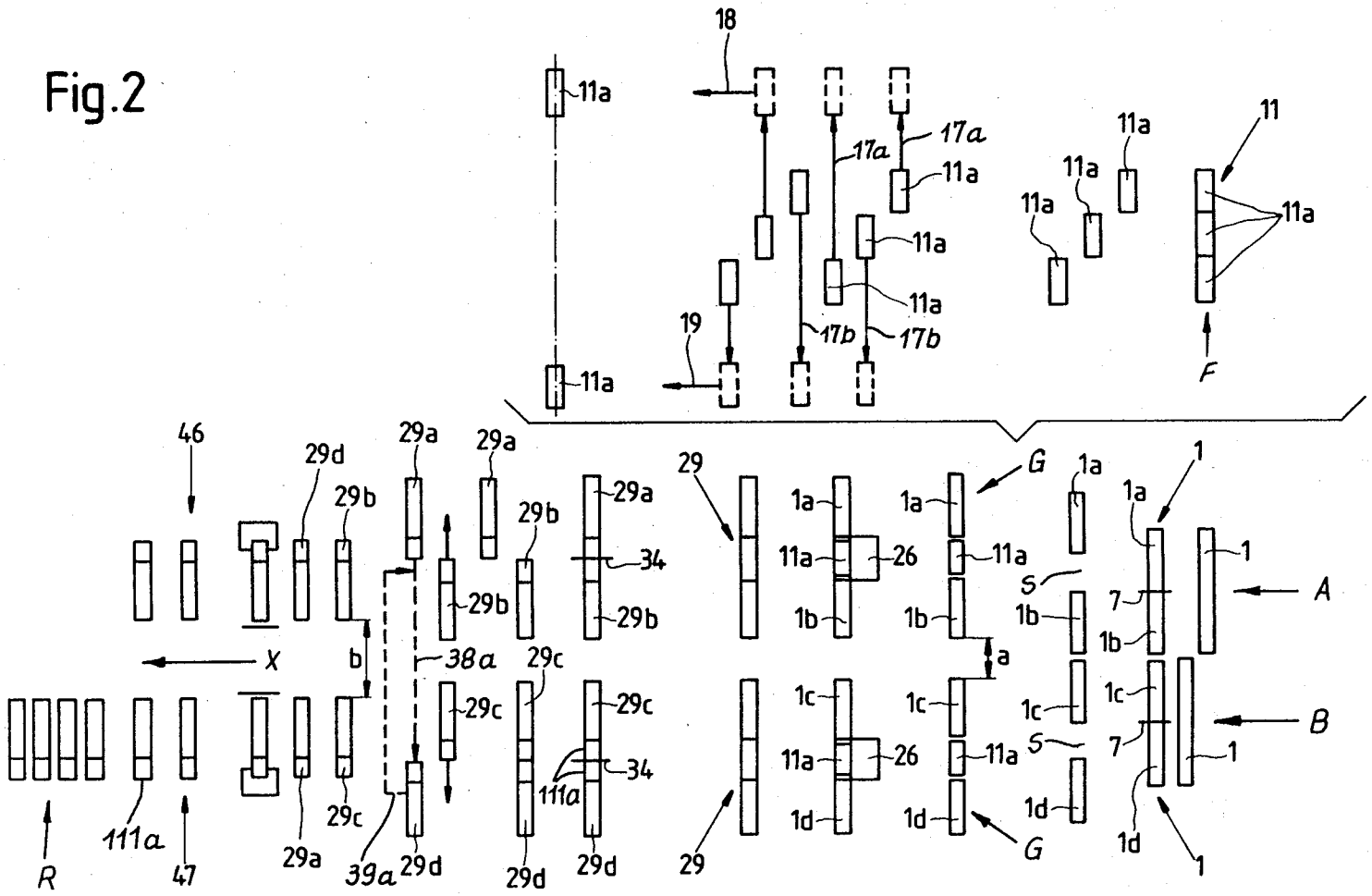
FIG. 2 is a schematic plan view of rod-shaped articles and uniting bands which are treated in the machine of FIG. 1, showing the manner in which plain cigarettes and filter mouthpieces are subdivided, shuffled, transported, connected to each other and the resulting filter cigarettes manipulated for the purpose of segregating defective articles and of converting satisfactory articles into a single row of filter cigarettes of unit length wherein all of the filter mouthpieces face in the same direction.

Referring to FIG. 1, there is shown a filter tipping machine which serves to turn out a single row R of filter cigarettes 29*a*–29*d* of unit length (see FIG. 2) wherein the filter mouthpieces llla face in the same direction. The character 5 denotes a conveyor which can be similar to or identical with the conveyor 4 shown in the copending patent application Ser. No. 127,243 of Schumacher. The orbiting arms of the conveyor 5 deliver plain cigarettes 1 of double unit length to two discrete rotary drum-shaped conveyors 2, 3 which can be said to correspond to the conveyors 12*a*, 12*b* of Schumacher and serve to deliver pairs of cigarettes 1 into successive axially parallel peripheral flutes a a rotary drum-shaped conveyor 4 corresponding to the conveyor 26 of Schumacher. The conveyor 3 delivers a row B and the conveyor 2 delivers a row A of parallel cigarettes 1 in such orientation that the cigarettes in the row A are staggered relative to the cigarettes in the row B (as seen in FIG. 2 in the direction of arrow X indicating the direction of (sidewise or transverse) movement of cigarettes 1 and portions of such cigarettes in the filter tipping machine). The conveyors 2, 3 can be said to constitute an aligning means which ensures that each cigarette 1 of the row A registers with a cigarette 1 of the row B not later than when such cigarettes enter the oncoming axially parallel peripheral flutes of the conveyor 4 which advances the two rows along two discrete paths. The conveyor 4 is one of several conveyors which serve to advance the cigarettes 1 and their portions as well as filter plugs 11*a* of double unit length in the direction of arrow X.

Each cigarette 1 of double unit length on the conveyor 4 is subdivided into two coaxial plain cigarettes 1*a*, 1*b* or 1*c*, 1*d* of unit length during travel in and with the respective flute of the conveyor 4 which cooperates with a subdividing means including two coaxial rotary disc-shaped knives 6 serving to make cuts 7 which are shown in FIG. 2. Each cigarette 1 which is supplied by the conveyor 3 (i.e., each cigarette of the row A) yields two coaxial plain cigarettes 1*a*, 1*b*, and each cigarette 1 of the row B which is supplied by the conveyor 2 yields two coaxial plain cigarettes 1*c*, 1*d*. Pairs of coaxial plain cigarettes 1*a*–1*b* and 1*c*–1*d* of unit length are thereupon transferred into successive axially parallel peripheral flutes of a further advancing conveyor 8 which cooperates with suitable spreading cams (not specifically shown in FIG. 1) serving to respectively move the cigarettes 1*a* and 1*d* axially and away from the aligned cigarettes 1*b*, 1*d* so as to establish gaps or spaces S each having a width at least matching the length of a filter plug or filter mouthpiece 11*a* of double unit length. The spreading cams are placed adjacent the path of movement of plain cigarettes 1*a*, 1*d* with the conveyor 8. Instead of pushing the cigarettes 1*a* and 1*d* away from the respective cigarettes 1*b* and 1*c*, it is equally within the purview of the invention to pull the cigarettes 1*a* and 1*d* toward the respective end faces of the drum-shaped conveyor 8, e.g., by suction in a manner well known from the art of cigarette making and processing as disclosed, for example, in commonly owned U.S. Pat. Nos. 3,535,003, 3,685,633 and 3,812,950 to Rudszinat et al. Mechanical shifting means for cigarettes in the flutes of rotary drum-shaped conveyors are disclosed in commonly owned U.S. Pat. No. 4,564,029 to Hinzmann et al. and in commonly owned U.S. Pat. No. Re 25,917 to Stelzer.

The frame or housing 10 of the filter tipping machine supports a magazine 9 which constitutes a source of supply of filter mouthpieces 11 of six times unit length. The outlet in the bottom part of the magazine 9 is located above the path of movement of axially parallel flutes at the periphery of a rotary drum-shaped withdrawing conveyor 12 which transports the filter mouthpieces 11 sideways (i.e., at right angles to their respective axes) and past two rotary disc-shaped knives 13, 14 which serve as a means for subdividing each mouthpiece 11 into a file F of three coaxial filter mouthpieces 11*a* of double unit length. The knives 13, 14 are staggered relative to each other in the circumferential direction of the withdrawing conveyor 12 and are spaced apart from each other in the axial direction of this conveyor. The withdrawing conveyor 12 delivers successive files F of three filter mouthpieces 11*a* each to a rotary staggering conveyor 16 which has three discs or wheels each receiving one filter mouthpiece 11*a* of a file F and each serving to advance the respective mouthpiece 11*a* through a different distance and/or at a different speed so that each file F is converted into a set of three filter mouthpieces 11*a* which are staggered relative to each other in a manner as shown in FIG. 2 immediately to the left of the file F. Reference may be had to commonly owned U.S. Pat. No. 3,308,832 to Stelzer et al. This provides room for axial shifting of some or all of the filter mouthpieces 11*a* on a further rotary drum-shaped conveyor 17 which receives mouthpieces 11*a* from the staggering conveyor 16. As can be seen in FIG. 2, the rearmost filter mouthpiece 11*a* of each file F is moved by a schematically shown shifting means 17*a* in a direction away from the other two filter mouthpieces 11*a* of the same file, the median mouthpiece 11*a* of the file F is moved by a schematically shown shifting means 17*b* in the opposite direction, the foremost mouthpiece 11*a* of the same file is shifted by a shifting means 17*a* in the same direction as the rearmost mouthpiece 11*a*, the rearmost mouthpiece 11*a* of the preceding file F is shifted by a shifting means 17*b* of the conveyor 17, and so forth so that the files F are converted into two successions or rows 18, 19 of parallel filter mouthpieces 11*a* which advance in a direction to the left as seen in FIG. 2. The filter mouthpieces 11*a* of the succession 18 are staggered relative to the filter mouthpieces 11*a* of the succession 19 and, therefore, the machine further comprises two rotary drum-shaped aligning conveyors 21, 22 which can operated in a manner analogous to that of the conveyors 2, 3 (see also commonly owned U.S. Pat. No. 3,164,242 to Schubert et al.) in order to ensure that each mouthpiece 11*a* of the succession 18 is aligned with a mouthpiece of the succession 19 before or not later than when the thus obtained pairs of coaxial mouthpieces 11*a* are introduced (by the conveyors 21, 22) into the spaces S between the oncoming pairs of coaxial cigarettes 1*a*, 1*b* and 1*c*, 1*d* of unit length. This takes place in successive flutes at the periphery of a further rotary drum-shaped advancing conveyor 23; such flutes receive pairs of plain cigarettes 1*a*–1*b* and 1*c*–1*d* of unit length from successive flutes of the aforementioned drum-shaped conveyor 8.

The shifting means 17*a*, 17*b* of the conveyor 17 can constitute cams or they can include suction ports which are provided in the flutes of the conveyor 17 and are connected, at appropriate intervals, to a suitable suction generating device (such as a fan) in order to draw the filter mouthpieces 11*a* in directions to assemble oddly numbered mouthpieces 11*a* into the succession 18 and to assemble evenly numbered mouthpieces 11*a* into the succession 19 or vice versa. It is also possible to blow the filter mouthpieces 11*a* in parallelism with the axis of the shifting conveyor 17 against suitable stops to thus form the successions 18 and 19. All that counts is to ensure that the mutual spacing of filter mouthpieces 11*a* which form the successions 18 and 19 matches the mutual spacing of spaces or gaps S in the flutes of the conveyor 23 which latter can be called an assembly conveyor in that its flutes gather groups G of three coaxial rod-shaped articles each, namely two plain cigarettes 1*a*–1*b* or 1*c*–1*d* of unit length and a filter mouthpiece 11*a* of double unit length between them. The conveyor 23 cooperates with suitable condensing means in the form of stationary cams or the like which serve to ensure that the inner end portions of the pairs of cigarettes 1*a*–1*b* and 1*c*–1*d* actually abut the respective end faces of the filter mouthpieces 11*a* between them prior to conversion of each group G into a filter cigarette 29 of double unit length.

The condensing means which cooperate with the conveyor 23 cause the development of clearances a (FIG. 2) between neighboring plain cigarettes 1*b*, 1*c* in successive flutes of the conveyor 23, and such clearances can be increased in order to ensure that the cigarettes 1*a*–1*b* and 1*c*–1*d* actually abut the respective filter mouthpieces 11*a* not later than at the time of conversion of groups G into filter cigarettes 29 of double unit length. Such conversion takes place on two additional rotary drum-shaped conveyors 24, 27 of the means for advancing plain cigarettes 1, their portions 1*a*–1*d* and filter mouthpieces 11*a* in the direction of arrow X.

The conveyor 24 advances successive pairs of coaxial groups G past a station where each such group is provided with an adhesive-coated uniting band 26. The bands 26 are applied in such a way that they extend substantially tangentially of the respective groups G and contact the respective filter mouthpieces 11*a* (all the way from the one to the other axial end) as well as the adjacent inner end portions of the respective cigarettes 1*a*–1*b* or 1*c*–1*d*. The conveyor 24 delivers successive pairs of coaxial groups G onto the conveyor 27 which constitutes one component of a means for rolling or convoluting the adhesive-coated uniting bands 26 around the respective groups G to thereby connect each filter mouthpiece 11*a* with the adjacent plain cigarettes 1*a*–1*b* or 1*c*–1*d* and to thus complete the conversion of groups G and uniting bands 26 into filter cigarettes 29 of double unit length.

The conveyor 27 cooperates with an adjustable stationary rolling device 28 to define therewith an arcuate channel wherein successive coaxial pairs of groups G roll about their respective axes to thus transform each uniting band 26 into a tube which sealingly surrounds the respective filter mouthpiece 11*a* and the adjacent end portions of the aligned plain cigarettes 1*a*–1*b* or 1*c*–1*d*. Thus, the articles which leave the arcuate passage between the conveyor 27 and the rolling device 28 are filter cigarettes 29 of double unit length which are advanced as pairs of coaxial filter cigarettes and are delivered into successive flutes of a rotary drum-shaped conveyor 31 cooperating with a laser or with another suitable device for making perforations in the wrappers of filter cigarettes 29, namely at least one set of perforations in each half of each cigarette 29. The thus obtained so-called ventilating or aerating zones of the wrappers permit entry of atmospheric air which is admixed to the column of tobacco smoke when an individual filter cigarette 29*a*, 29*b*, 29*c* or 29*d* of unit length is lighted. A device which can be used in the machine of FIG. 1 in conjunction with the conveyor 31 is disclosed in commonly owned U.S. Pat. No. 4,281,670 to Heitmann et al. Rolling devices which can be adapted for use in the machine of FIG. 1 (at 27, 28) are disclosed in commonly owned U.S. Pat. No. 3,527,234 to Hinzmann.

The conveyor 31 delivers pairs of filter cigarettes 29 (each such filter cigarette is provided with two sets of perforations, one set for the cigarette 29*a* or 29*c* and the other set for the cigarette 29*b* or 29*d*) into successive axially parallel peripheral flutes of a severing or subdividing conveyor 32 cooperating with two coaxial rotary disc-shaped knives 33 so as to subdivide each filter cigarette 29 into two filter cigarettes 29*a*, 29*b* or 29*c*, 29*d* of unit length. The knives 33 make cuts 34 (FIG. 2) midway across the convoluted uniting bands so that the filter mouthpiece 111*a* of unit length of the cigarette 29*a* is adjacent the filter mouthpiece 111*a* of unit length of the cigarette 29*b* and that the filter mouthpieces of coaxial cigarettes 29*c*, 29*d* are also adjacent each other.

The thus obtained four rows of filter cigarettes 29*a*–29*d* of unit length are thereupon transformed into two rows. In the first step, a rotary drum-shaped conveyor 36 receives successive files of three filer cigarettes 29*b*–29*d* each whereas a rotary drum-shaped conveyor 35 receives successive filter cigarettes 29*a*. The conveyor 35 staggers the cigarettes 29*a* relative to the cigarettes 29*b*–29*d*. The conveyors 35, 36 deliver the cigarettes 29*a*–29*d* (with the cigarette 29*a* staggered relative to the cigarettes 29*b*–29*d*) to a rotary drum-shaped transfer conveyor 37 which, in turn, delivers the cigarettes 29*a*–29*c* to an upper rotary drum-shaped shifting conveyor 38 while delivering the cigarettes 29*d* to a lower rotary drum-shaped shifting conveyor 39. The cigarettes 29*a* on the conveyor 38 are shifted axially by shifting means 38*a* toward positions of alignment (as seen in the direction of arrow X) with the cigarettes 29c, and the cigarettes 29d are shifted by shifting means 39a toward positions of alignment with the cigarettes 29b (it will be noted that the filter mouthpieces 111a of the cigarettes 29a, 29c and 29b, 29d face in the same direction). The shifting means 38a and 39a can mechanically and/or pneumatically push or pull the cigarettes 29a and 29d in their respective flutes. The result of such shifting on the conveyors 38, 39 is that the filter cigarettes 29a, 29c form a first row 47 and the cigarettes 29b, 29d form a second row 46. The mutual spacing of cigarettes 29a, 29c and 29b, 29d in the rows 47, 46 is shown at b.

The shifting conveyors 38, 39 transfer the rows 47, 46 of filter cigarettes 29a, 29c and 29b, 29d onto a first rotary drum-shaped testing conveyor 41 on which the head ends of the cigarettes 29a–29d can be tested for density (such testing is desirable in order to detect filter cigarettes wherein the free ends of the respective plain cigarettes 1a, 1b, 1c or 1d are too soft and are likely to lose additional tobacco which is a frequent cause of annoyance to smokers because it contaminates the packet, the pocket or the purse of the smoker). The manner of testing the ends of tobacco-containing portions of filter cigarettes is well known in the art and is disclosed in numerous U.S. and foreign patents of the assignee of the present application.

The testing conveyor 41 delivers the rows 47, 46 of filter cigarettes 29a, 29c and 29b, 29d of unit length to a second rotary drum-shaped testing conveyor which comprises or cooperates with means for testing the condition of wrappers of the cigarettes 29a–29d for the presence of smudges, frayed ends, holes, open seams and/or other defects. The assignee of the present application owns numerous U.S. and foreign patents which describe presently preferred modes of testing the wrappers of rod-shaped articles of the tobacco processing industry.

Defective cigarettes 29a, 29b, 29c and/or 29d are segregated from satisfactory cigarettes on a further rotary drum-shaped conveyor 43 which cooperates with a suitable (e.g., pneumatic) ejecting or expelling device serving to segregate defective cigarettes (i.e., those found to be defective during travel with the conveyor 41 and/or 42) from satisfactory cigarettes. The conveyor 43 delivers satisfactory filter cigarettes 29a–d to the flutes of a further rotary drum-shaped conveyor 44. A rotary drum-shaped conveyor 45 can be activated, when necessary, in order to withdraw samples of cigarettes 29a–29d for testing in a laboratory independently of the testing operations carried out during travel of filter cigarettes with the testing conveyors 41 and 42. Such inspection of selected batches of filter cigarettes serves to ascertain the quality of testing on the conveyors 41, 42 and/or to carry out other tests which are not or cannot be carried out during travel of filter cigarettes with the conveyors 41–42.

The conveyor 44 can be said to constitute one conveyor of a turn-around device which further comprises rotary drum-shaped conveyors 48, 49, 51 and a conical or otherwise configurated inverting unit 52, e.g., of the type disclosed in commonly owned U.S. Pat. No. 3,583,546 to Koop or in commonly owned U.S. Pat. No. 3,176,825 to Rudszinat et al.

The conveyor 44 delivers the row 46 of cigarettes 29b, 29d to the flutes of the conveyor 49 while delivering the row 47 of cigarettes 29a, 29c to the flutes of the conveyor 48. The inverting unit 52 cooperates with the conveyor 49 to invert the cigarettes 29b, 29d of the row 46 end-for-end and to place the inverted cigarettes into alternate flutes of the rotary drum-shaped conveyor 51 which further receives non-inverted cigarettes 29a, 29c (row 47) from the conveyor 48. This entails a conversion of the rows 46, 47 into a single row R wherein the filter mouthpieces 111a of all cigarettes 29a–29d face in the same direction. The conveyor 51 delivers the single row R onto the upper reach of an endless belt conveyor 53 which can transport the cigarettes 29a–29d to storage or directly into a packing machine, not shown. The mutual spacing of flutes at the periphery of the conveyor 51 is half the mutual spacing of flutes at the periphery of the conveyor 48 or 49.

The filter tipping machine further comprises means for supplying two series of uniting bands 26 to the assembly conveyor 24 for application to successive pairs of groups G. To this end, the frame 10 of the filter tipping machine supports a source of supply of tipping paper including two coaxial expiring bobbins or reels 54 of strips or webs 56a, 56b of tipping paper (e.g., cigarette paper or artificial cork) which advance along separate routes or paths, preferably in such a way that the route portions immediately downstream of the expiring reels 54 are closely or immediately adjacent each other. The webs 56a, 56b first advance through splicing devices 57 (e.g., of the type disclosed in commonly owned U.S. Pat. No. 3,586,006 to Wendt which are activated when the supply of tipping paper on the respective reel 54 is exhausted so as to splice the trailing end of the web 56a or 56b to the leader of a fresh web 156a or 156b stored on one of two coaxial fresh bobbins or reels 58.

The splicing devices 57 are followed by a web guide 59 which defines two accurately determined routes for the webs 56a, 56b to thus ensure that the webs cannot stray laterally during entry into and during travel through a web perforating device 61 which is indicated in FIG. 1 by phantom lines because it constitutes an optional feature of the filter tipping machine. This perforating device 61 can be used in addition to or in lieu of the perforating means including the conveyor 31. As a rule, the perforating device 61 will be used in lieu of the perforating means including the conveyor 31 or vice versa. Web perforating devices are disclosed in the aforementioned patent No. 4,281,670 to Heitmann et al.

The webs 56a, 56b are then conveyed through a paster or through two discrete pasters 62 serving to provide one side of each web with a film of suitable adhesive before the webs 56a, 56b advance, along laterally spaced-apart portions of their routes, to a rotary drum-shaped suction conveyor 66 which cooperates with two rotary knife carriers 68, 69 to subdivide the webs 56a, 56b into two series of discrete uniting bands 26. The webs 56a, 56a must be moved apart (i.e., at least one of these webs must be moved at right angles to the plane of FIG. 1) in order to establish between the two webs a clearance which corresponds to that between the two uniting bands 26 shown in FIG. 2 (on the conveyor 24). The web 56b is advanced from the paster or pasters 62 to move along guide rollers 63, 64 and thereupon to the periphery of the suction conveyor 66. The peripheral surface of the conveyor 66 is formed with suction ports to attract the leaders of the webs while the leaders are severed by successive axially parallel orbiting knives (not specifically shown) of the knife carrier 69 (web 56b) or 68 (web 56a). The angle along which the leader of the web 56b extends in contact with the peripheral surface of the suction conveyor 66 must be sufficiently large to ensure that the conveyor 66 can maintain the web 56b under tension. Successive uniting bands 26 which are obtained as a result of severing of the leader of the web 56b are attracted to the peripheral surface of the conveyor 66 by suction during travel from the knife carrier 69 to the transfer station between the conveyors 24, 66 where the adhesive-coated sides of the uniting bands 26 come in contact with the oncoming groups G on the conveyor 24.

Successive increments of the web 56a are caused to cover a shorter distance on their way from the paster or pasters 62 to the periphery of the suction conveyor 66. Such increments are diverted or deflected toward the observer of FIG. 1 by a deflecting means 67 so as to move away from the route of the web 56b and into the range of successive axially parallel orbiting knives on the rotary knife carrier 68 to sever the leader of the web 56a at regular intervals and to thus form the other series of discrete uniting bands 26.

The peripheral speed of the suction conveyor 66 can slightly exceed the speed of the webs 56a, 56b so that the peripheral surface of the conveyor 66 slips relative to the webs in order to ensure that successively formed uniting bands 26 are slightly spaced apart from one another and, therefore, a next-following uniting band cannot interfere with the application of the preceding uniting band to the oncoming group G on the assembly conveyor 24.

The suction conveyor 66 can cooperate with the knives on the knife carriers 68, 69 in a manner as disclosed in commonly owned U.S. Pat. No. 3,340,757 to Rudszinat or in a manner as disclosed in commonly owned U.S. Pat. No. 4,503,867 to Barbe et al.

Since the route or path of the web 56b deviates from the route or path of the web 56a, and since it is necessary to the ensure that the conveyor 66 will properly tension both webs, preferably with the same force, the mutual inclination of the end portions of these routes (at the peripheral surface of the suction conveyor 66 of the subdividing device including the conveyor 66 and the knife carriers 68, 69) is selected in such a way that the angle along which the leader of the web 56a overlies the peripheral surface of the conveyor 66 is the same as (or closely approximates) the angle of overlap of the leader of the web 56b with the peripheral surface of the conveyor 66 (as seen in the circumferential direction of the conveyor 66). This angle should be sufficiently large to ensure that the conveyor 66 can draw the webs 56a, 56b and maintain the webs under requisite tension without preventing the leaders from slipping with reference to the foraminous or perforated peripheral surface. The orientation of the end portions of the routes for the webs 56a, 56b at an angle to each other is desirable and advantageous on the additional ground that the sets of orbiting knives on the carriers 68, 69 can be staggered relative to each other in the circumferential direction of the conveyor 66. This ensures that each of these knife carriers is readily accessible.

Figure 3:
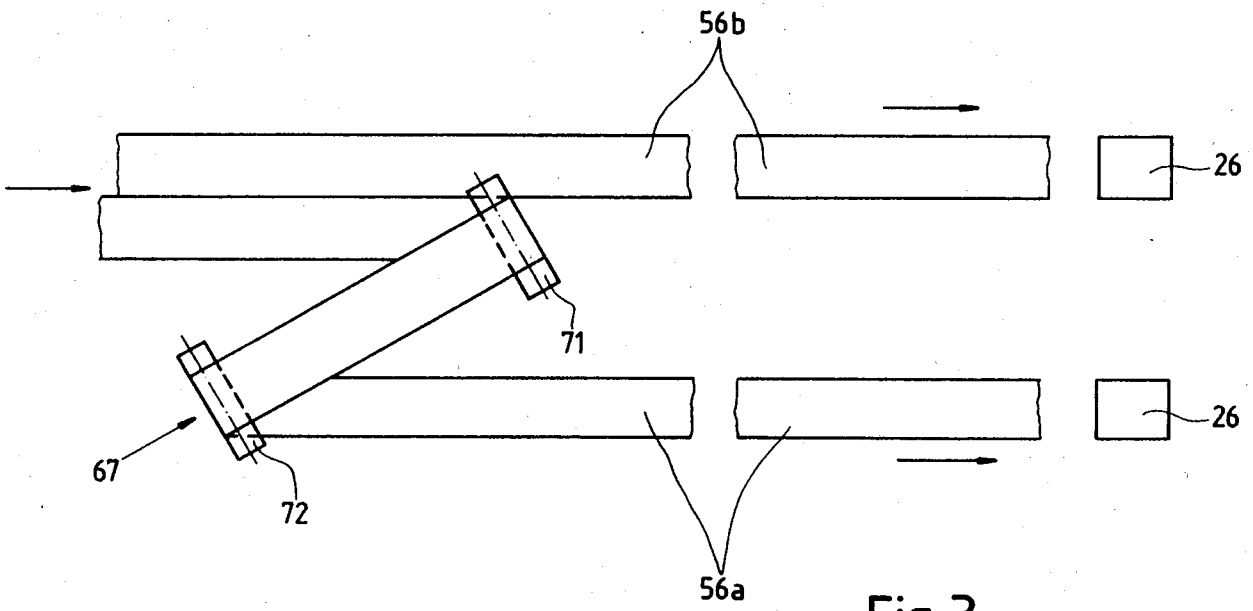
FIG. 3 is an enlarged view of a detail as seen in the direction of arrow I in FIG. 1 and shows the manner of increasing the distance between the routes for two webs of tipping paper.

FIG. 3 shows a presently preferred form of the diverting or deflecting means 67 for one of the webs 56a, 56b. As shown in the left-hand portion of FIG. 3, the routes or paths for the webs 56a, 56b are closely adjacent each other upstream of the deflecting means 67, i.e., all the way from the source including the reels 54 to the first roller or wheel 71 of the deflecting means 67. A second roller 72 of the deflecting means 67 is parallel or nearly parallel to the follwer 71, and these rollers are inclined with reference to the first portions of the routes of the webs 56a, 56b. The roller 71 causes the web 56a to change the direction of its movement substantially counter to the first direction (toward the roller 71) so that the web 56a has a component of movement at right angles to its first direction of movement (i.e., downwardly as seen in FIG. 3). The roller 72 thereupon changes the direction of movement of the web 56a so that the distance between the routes of the webs 56a, 56b then equals the required distance between the two series of uniting bands 26 which are obtained as a result of repeated severing of the leaders of the webs 56a, 56b on the peripheral surface of the suction conveyor 66. The distance from the series of uniting bands 26 which are obtained as a result of repeated severing of the leader of the web 56a from the series of uniting bands 26 which are obtained as a result of repeated severing of the leader of the web 56a equals the distance between the two rows of the groups G on the conveyor 24, namely between the row of groups G which include the cigarettes 1a, 1b and the row of groups G which include the cigarettes 1c, 1d.

That portion of the route of the web 56a which is defined by the rollers 71, 72 of the deflecting means 67 has the shape of the letter Z. It is clear that, if the space which is available for the transport of webs 56a, 56b from the source including the reels 54 to the suction conveyor 66 is of such configuration that it is necessary to change the direction of movement of the web 56a as well as of the web 56b, the deflecting means 67 is modified to employ two additional rollers serving to impart to a portion of the route for the web 56b the shape of a letter Z. Certain other types of deflecting means for one or both webs can be used with equal or similar advantage without departing from the spirit of the invention.

It is further within the purview of the invention to provide a source which contains a single bobbin or reel of tipping paper having a width matching the combined width of the webs 56a and 56b. Such relatively wide web of tipping paper is then split into two discrete webs, for example, downstream of the paster 62. The thus obtained webs are then advanced to the peripheral surface of the suction conveyor 66 in the same way as shown and described in connection with the webs 56a, 56b or in any other suitable way, as long as the mutual spacing of the two series of uniting bands 26 matches the mutual spacing of the two rows of groups G on the conveyor 24.

An advantage of the improved filter tipping machine is its compactness as well as its simplicity. The output of the machine is a multiple of the output of a conventional machine which processes a single row of plain cigarettes of double unit length. Such earlier machines are disclosed, for example, in commonly owned U.S. Pat. Nos. 3,245,414 and 3,306,306 to Rudszinat and in commonly owned U.S. Pat. No. Re. 26,900 to Bohn et al. The improved machine can employ simple rotary conveyors which can be disposed in pairs and whose drives can be readily synchronized in a manner well known from the art of conventional filter tipping machines. This applies for the conveyors which transport plain cigarettes and filter cigarettes as well as for the conveyors which transport filter mouthpieces to the transfer station between the conveyors 21–22 and 23.

The feature that the machine transports and processes pairs of initially staggered and thereupon aligned cigarettes of double unit length renders it possible to directly couple the machine to existing transfer mechanisms (such as the afore-mentioned transfer mechanism of Schumacher) which receive plain cigarettes of double unit length from makers wherein plural sigarette rods are converted into plain cigarettes. The conveyors which define the path for the cigarettes of the row A can be coaxial or integral with the conveyors for the cigarettes of the row B. This renders it possible to achieve significant savings in space and to simplify the drive means for the conveyors.

The knives 13, 14 can be mounted in such a way that they rotate about a common axis (to simplify the drive means for the knives). The illustrated construction (according to which the knives 13, 14 are staggered relative to each other in the circumferential direction of the withdrawing conveyor 12) is preferred at this time because the knives 13, 14 are more readily accessible for inspection, sharpening or replacement. This also holds true for the knife carriers 68, 69. The knives 13, 14 can be mounted, and the withdrawing conveyor 12 can be designed, in a manner as disclosed in commonly owned U.S. Pat. No. 4,554,931 to Born.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

We claim:

1. A method of making filter cigarettes from cigarettes of double unit length, filter mouthpieces of double unit length and adhesive-coated uniting bands, comprising the steps of advancing two rows of parallel cigarettes of double unit length along two discrete paths in a predetermined direction; subdividing the cigarettes in each of the rows into pairs of cigarettes of unit length; introducing a filter mouthpiece of double unit length between each pair of cigarettes of unit length to thus form first and second rows of groups each containing two cigarettes of unit length and a filter mouthpiece of double unit length between them; establishing a source of supply of tipping paper; applying adhesive to one side of tipping paper; drawing tipping paper from the source; subdividing the withdrawn tipping paper into first and second series of discrete uniting bands; and convoluting successive uniting bands of the first and second series of uniting bands around successive groups of the first and second rows of groups, respectively, to thus convert the groups into filter cigarettes of double unit length wherein the uniting bands connect the respective pairs of cigarettes of unit length with the filter mouthpieces of double unit length between them.

2. The method of claim 1, wherein the source of supply contains discrete first and second webs of tipping paper and said drawing step includes conveying the first and second webs along discrete first and second routes, said adhesive applying step including coating said discrete webs and said step of subdividing tipping paper including repeatedly severing the leaders of the webs at the ends of their respective routes.

3. The method of claim 2, wherein the distance which is covered by the second web from the source to the end of the second route exceeds the distance which is covered by the first web from the source to the end of the first route.

4. The method of claim 2, further comprising the step of moving at least one of the webs away from the other of the webs in a preselected portion of the respective route so that the mutual spacing of the webs at the ends of the respective routes exceeds the mutual spacing of the webs in the source.

5. The method of claim 4, wherein said moving step includes imparting to the at least one web a movement along a substantially Z-shaped portion of the respective route.

6. A machine for making filter cigarettes from cigarettes of double unit length, filter mouthpieces of double unit length and adhesive-coated uniting bands, comprising means for advancing two rows of cigarettes of double unit length along two discrete paths in a predetermined direction; means for subdividing the cigarettes in each of said rows into pairs of cigarettes of unit length; means for introducing a filter mouthpiece of double unit length between each pair of cigarettes of unit length to thus form first and second rows of groups each of which contains two cigarettes of unit length and a coaxial filter mouthpiece of double unit length between them; a source of supply of tipping paper; means for drawing tipping paper from said source; means for applying adhesive to one side of tipping paper; a device for subdividing tipping paper into first and second series of discrete adhesive-coated uniting bands; and means for convoluting successive uniting bands of said first and second series around successive groups of said first and second rows of groups to thus convert the groups into filter cigarettes of double unit length wherein the uniting bands connect the respective pairs of cigarettes of unit length with the filter mouthpieces of double unit length between them.

7. The machine of claim 6, wherein said source contains supplies of discrete first and second webs of tipping paper and said drawing means includes means for conveying the first and second webs along separate first and second routes, at least in the region of said subdividing device.

8. The machine of claim 7, wherein said conveying means comprises means for deflecting at least one of the webs away from the other of the webs intermediate the source and the subdividing device.

9. The machine of claim 8, wherein said deflecting means comprises rollers defining for the at least one web a substantially Z-shaped portion of the respective route wherein the at least one web first moves forwardly in a first direction, thereupon with a component of movement at right angles to the first direction, and then again in or close to the first direction.

10. The machine of claim 7, wherein said routes include mutually inclined end portions adjacent said subdividing device.

11. The machine of claim 7, wherein said subdividing device includes a rotary suction conveyor having a peripheral surface which attracts the leaders of the webs, and first and second orbiting knives respectively arranged to sever the leaders of the first and second webs on the suction conveyor.

12. The machine of claim 11, wherein said first and second knives are staggered relative to each other in the circumferential direction of said suction conveyor.

13. The machine of claim 12, wherein said routes have mutually inclined end portions in the region of said suction conveyor so that the leaders of both webs overlie the peripheral surface of the suction conveyor along substantially identical angles intermediate the end portions of the respective routes and the respective knives.

* * * * *

UNITED STATES PATENT AND TRADEMARK OFFICE

CERTIFICATE OF CORRECTION

PATENT NO. : 4,825,883

DATED : May 2, 1989

INVENTOR(S) : Werner Hinz et al.

It is certified that error appears in the above-identified patent and that said Letters Patent is hereby corrected as shown below:

On the foremost page, in item [30] Foreign Application Priority Data, "3706571" should read --3706751--.

Col. 7, line 52, "a" should read --a--.

Col. 9, line 12, "b" should read --b--.

Col. 13, line 1, "sigarette" should read --cigarette--.

Signed and Sealed this

Fifteenth Day of October, 1991

*Attest:*

HARRY F. MANBECK, JR.

*Attesting Officer*

*Commissioner of Patents and Trademarks*